United States Patent [19]

Iijima et al.

[11] Patent Number: 4,460,454

[45] Date of Patent: Jul. 17, 1984

[54] PROCESS FOR PRODUCING PITCH FOR USING AS RAW MATERIAL FOR CARBON FIBERS

[75] Inventors: Hiroshi Iijima; Kunihiko Moriya, both of Tokyo; Kazuhito Tate, Kanagawa; Goro Muroga, Tokyo; Kazuhiro Yanagida, Kanagawa; Yoshikazu Nakamura, Kanagawa; Akiyoshi Inoue, Kanagawa; Masahiro Higashi, Kanagawa, all of Japan

[73] Assignee: Mitsubishi Oil Co., Ltd., Tokyo, Japan

[21] Appl. No.: 456,453

[22] Filed: Jan. 7, 1983

[51] Int. Cl.[3] ..... C10C 3/06; C10C 3/08

[52] U.S. Cl. ..... 208/40; 208/45; 208/71; 208/89; 208/86; 423/447.4

[58] Field of Search ..... 208/40, 45, 71, 89, 208/86; 423/447.1, 447.2, 447.4, 447.6, 449

[56] References Cited

U.S. PATENT DOCUMENTS

| | | | |
|---|---|---|---|
| 2,242,504 | 5/1941 | Benedict | 208/57 |
| 2,768,119 | 10/1956 | Nash | 208/22 |
| 2,775,544 | 12/1956 | Corneil et al. | 208/86 |
| 2,847,306 | 8/1958 | Stewart et al. | 208/22 |
| 2,875,149 | 2/1959 | Beavon | 208/86 |
| 2,931,766 | 4/1960 | Ranch | 208/45 |
| 2,943,047 | 6/1960 | Reeg et al. | 208/45 |
| 3,227,645 | 1/1966 | Frumkin | 208/89 |
| 3,382,084 | 5/1968 | Folkins | 208/45 |
| 3,488,277 | 1/1970 | Fauber | 208/4 |
| 3,490,586 | 1/1970 | Gaisle | 208/45 |
| 3,725,245 | 4/1973 | Woodle | 208/86 |
| 3,767,741 | 10/1973 | Toyoguchi | 423/447.4 |
| 3,779,895 | 12/1973 | Wilson et al. | 208/309 |
| 3,779,896 | 12/1973 | Woodle | 208/309 |
| 3,784,679 | 1/1974 | Chiche | 423/447.1 |
| 3,796,653 | 3/1974 | Gatsis | 208/309 |
| 3,801,342 | 4/1974 | Berber et al. | 208/22 |
| 3,974,264 | 8/1976 | McHenry | 423/447.4 |
| 3,976,729 | 8/1976 | Lewis et al. | 264/29.7 |
| 4,005,183 | 1/1977 | Singer | 423/447.4 |
| 4,026,788 | 5/1977 | McHenry | 208/39 |
| 4,115,527 | 9/1978 | Otani et al. | 423/447.4 |
| 4,271,006 | 6/1981 | Dickakian | 208/45 |
| 4,309,271 | 1/1982 | Dorner | 208/57 |
| 4,359,379 | 11/1982 | Usihio et al. | 208/86 |
| 4,363,715 | 12/1982 | Dickakian | 208/45 |

FOREIGN PATENT DOCUMENTS

| | | | |
|---|---|---|---|
| 54-0015907 | 2/1979 | Japan | 208/86 |
| 7610511 | 3/1978 | Netherlands | 208/86 |

*Primary Examiner*—Delbert E. Gantz
*Assistant Examiner*—Helane E. Maull
*Attorney, Agent, or Firm*—Sughrue, Mion, Zinn, Macpeak & Seas

[57] ABSTRACT

A process for producing a pitch which is used as a raw material for producing carbon fibers is disclosed. The process comprises subjecting a petroleum heavy residual oil to hydrogenation treatment in the presence of catalysts, removing a low boiling point fraction of the oil by reduced pressure distillation, subjecting the resulting reduced pressure distillation residual oil to solvent extraction treatment, and carrying out thermal modification of the resulting extraction component.

By utilizing the process for producing the pitch it is possible to use a wide variety of different types of oils in order to produce carbon fibers. The carbon fibers produced from the pitch produced according to the disclosed process have desirable characteristics.

2 Claims, No Drawings

PROCESS FOR PRODUCING PITCH FOR USING AS RAW MATERIAL FOR CARBON FIBERS

FIELD OF THE INVENTION

The present invention relates to a process for producing a pitch (which is an improved raw material for producing carbon fibers having a high modulus of elasticity), using a petroleum heavy residual oil.

BACKGROUND OF THE INVENTION

In pitches which are used as a raw material for producing carbon fibers having excellent strength and excellent modulus of elasticity, optical anisotropy is observed by a polarizing microscope. It has been believed that such pitches contain a mesophase. Further, these pitches used as a raw material for carbon fibers need not possess only optical anisotropy but must also be capable of being stably spun.

Accordingly, in order to produce carbon fibers having excellent strength and excellent modulus of elasticity, it is not always possible to use any material as the raw material for making pitches. Materials having specified properties are required. However, in many published patents, for example, U.S. Pat. Nos. 3,976,729 and 4,206,788, the raw material is not specifically described or disclosed in the patent specifications and it appears as if pitches used as a raw material for carbon fibers can be produced by carrying out thermal modification of a wide variety of raw materials.

However, when the detailed descriptions and examples in such patents are examined in detail, it becomes apparent that desired pitches can only be produced by using the specified raw materials described in the examples of such patents. For example, U.S. Pat. No. 4,115,527 discloses that substances such as chrysene or tarry materials by-produced during the high temperature cracking of petroleum crude oil are suitable for producing the pitch, i.e., a carbon precursor, but conventional petroleum asphalts and coal tar pitches are not suitable.

U.S. Pat. No. 3,974,264 discloses that an aromatic base carbonaceous pitch having a carbon content of about 92 to 96% by weight and a hydrogen content of about 4 to 8% by weight is generally suitable for preparation of a mesophase pitch. It has been described that elements excepting carbon and hydrogen, such as oxygen, sulfur and nitrogen, should not be present in an amount of more than about 4% by weight, because they are not suitable. Further, it has been described that the precursor pitch used in Example 1 of the same patent publication has properties comprising a density of 1.23 g/cc, a softening point of 120° C., a quinoline insoluble content of 0.83% by weight, a carbon content of 93.0%, a hydrogen content of 5.6%, a sulfur content of 1.1% and an ash content of 0.044%. Even if the density of 1.23 g/cc in these properties is maintained, petroleum fractions having such a high density are hardly known in conventional petroleum fractions. U.S. Pat. Nos. 3,976,729, 4,026,788 and 4,005,183 also describe examples wherein the pitch is produced using a specified raw material.

The properties of heavy petroleum oils actually depend essentially upon the properties of crude oils from which they were produced and the process for producing the heavy oil. However, it is rare for heavy oils to have the suitable properties described in the above examples, and such oils are often not available. Accordingly, in order to produce carbon fibers having excellent strength and excellent modulus of elasticity industrially in a stabilized state using petroleum heavy oils, it is necessary to develop a process for producing a pitch wherein the properties of the finally resulting pitch are stabilized even if the properties of the raw materials used for making the pitch vary.

SUMMARY OF THE INVENTION

The present invention relates to a process for producing an improved pitch which is used for producing carbon fibers having a high modulus of elasticity. The pitch is produced industrially in a stabilized state using not only a specified raw material but also an easily available petroleum heavy residual oil.

The pitch used for producing carbon fibers having a high modulus of elasticity is produced by a process which comprises subjecting a petroleum heavy residual oil to hydrogenation treatment in the presence of a catalyst, removing a low boiling point fraction by reduced pressure distillation, subjecting the resulting reduced pressure distillation residual oil to solvent extraction treatment with using an organic solvent, and carrying out thermal modification of the resulting extraction component.

DETAILED DESCRIPTION OF THE INVENTION

There are a large number of different petroleum heavy residual oils and the properties of them vary over a fairly wide range depending upon the different crude oils from which they are produced or the process for producing them from crude oils. The hydrogenation treatment by which the above-described difference is reduced is carried out in the presence of a catalyst at a temperature of 370° to 450° C., preferably 380° to 410° C., a pressure of 70 to 210 $Kgf/cm^2$, preferably 100 to 170 $Kgf/cm^2$, a liquid space velocity of 0.4 to 2.0 $Hr^{-1}$, preferably 0.4 to 1.0 $Hr^{-1}$, and a ratio of hydrogen/oil of 700 to 1,700 $Nm^3/Kl$, preferably 800 to 1,500 $Nm^3/Kl$. By such a process components contained in the petroleum heavy residual oil, such as sulfur, nitrogen, oxygen and slight amounts of metals, etc., are removed. Further, at the same time, the amount of aromatic components having a comparatively high molecular weight such as asphaltenes is reduced by the hydrogenation treatment.

Petroleum heavy residual oils to be subjected to such hydrogenation treatment have a boiling point of 300° C. or more and are prepared with a conventional distillation apparatus used in the petroleum industry. The conditions of the hydrogenation treatment are suitably controlled within the above-described ranges according to properties of the petroleum heavy residual oil.

The petroleum heavy residual oil is first subjected to hydrogen treatment and then processed by a reduced pressure distillation apparatus to remove a low boiling point fraction. The low boiling point fraction to be removed in this case means a fraction having a boiling point of about 450° C. or less and, preferably, 500° C. or less when distilling by means of a reduced pressure distillation apparatus conventionally used in the petroleum industry.

The resulting reduced pressure distillation residual oil is then subjected to solvent extraction treatment using an organic solvent, and the component extracted with the solvent is taken out.

This solvent extraction treatment is carried out in order to reduce the amount of the asphaltene in the reduced pressure distillation residual oil, by which the asphaltene is nearly completely removed in addition to the effect of removing the asphaltene by the abovedescribed hydrogenation treatment.

The asphaltene is one component in case of analyzing by solvent fractionation. More specifically, it is the component which is insoluble in n-heptane and soluble in benzene when carrying out solvent fractionation.

The solvent extraction treatment is carried out using saturated hydrocarbon compounds as a solvent which have 3 to 7 carbon atoms. These compounds may be one or more of propane, butane, pentane, hexane and heptane. When the treatment is carried out the ratio of solvent to oil is 3:1 to 15:1, the temperature is 50° to 230° C. and the pressure is 5 to 50 Kgf/cm$^2$. Thereby, the extraction component is obtained. The condition of solvent extraction treatment is suitably controlled with consideration to the properties of the reduced pressure distillation residual oil and properties of the extraction component.

As described above, since sulfur, nitrogen, oxygen, metals and asphaltene, etc., are removed from the petroleum heavy residual oil by carrying out hydrogenation treatment, reduced pressure distillation and solvent treatment, the difference in the properties is finally eliminated resulting in a product having uniform properties, even if the initial properties of the petroleum heavy residual oil are fairly different from others. The sulfur content, vanadium content, nickel content, and asphaltene content in the extraction component which are removed from the petroleum heavy residual oil are 2.5 wt% or less, 15 ppm or less, 7 ppm or less, and 0.05 wt% or less, respectively. Further, the properties of the oils become suitable for the following thermal modification.

The above-described extraction component is then subjected to thermal modification under a condition comprising a temperature of 390° to 430° C. to obtain a pitch used as a raw material for carbon fibers. It is necessary that the time for thermal modification is controlled within a range such that infusible materials which obstruct spinning are not formed when carrying out melt spinning of the above-described pitch used as a raw material for carbon fibers.

As described above, properties of the petroleum heavy residual oils may be fairly different from each other. Therefore, it is generally difficult to directly produce a pitch used as a raw material for carbon fibers having a high strength and a high modulus of elasticity from every petroleum heavy residual oil. However, some oils may be used for directly producing the pitch used as a raw material for carbon fibers having a high strength and a high modulus of elasticity.

The present invention is characterized by the fact that the pitch used as a raw material for the carbon fibers having a high modulus of elasticity can be produced industrially and stably using various kinds of petroleum heavy residual oils including the petroleum heavy residual oils which cannot be used for producing the pitch by the conventional process, by carrying out a series of processings comprising hydrogenation→reduced pressure distillation→solvent extraction→thermal modification.

The pitch thus produced by the invention is utilized to produce the carbon fiber. The carbon fiber can be produced by the conventional processes, for example, the process as described in U.S. Pat. No. 3,767,741 which comprises spinning the pitch as a raw material, infusiblizing and carbonizing.

In the following, the present invention is illustrated in greater detail by examples. However, the invention is not limited to these examples.

EXAMPLE 1

After a heavy residual oil having a boiling point of 350° C. or more prepared by distillation of Middle East crude oil (A) was subjected to hydrogenation treatment under a condition comprising a temperature of 390° C., a pressure of 160 Kgf/cm$^2$, a liquid space velocity of 0.5 Hr$^{-1}$ and a ratio of hydrogen/oil of 1,000 Nm$^3$/Kl, a fraction having a boiling point of 500° C. or less was removed by reduced pressure distillation. The resulting reduced pressure residual oil was subjected to solvent extraction treatment with heptane as a solvent under a condition comprising a ratio of solvent to oil of 10:1, a temperature of 180° C. and a pressure of 40 Kgf/cm$^2$. The resulting extraction component was subjected to thermal modification at a temperature of 410° C. for 10 hours to obtain a pitch used as a raw material for carbon fibers.

Properties of the heavy residual oil from Middle East crude oil (A) used as a raw material, those of the solvent extraction component and those of the pitch used as a raw material for carbon fibers are shown in Table 1.

Further, carbon fibers which were obtained by melt spinning of the above-described pitch used as a raw material for carbon fibers at 360° C., infusiblizing at 260° C. in the air and carbonizing at 1,000° C. had a tensile strength of 11 tons/cm$^2$ and a modulus of elasticity of 1,000 tons/cm$^2$.

When the fibers prepared by carbonizing at 1,000° C. were additionally graphitized at 1,800° C., they had a tensile strength of 15 tons/cm$^2$ and a modulus of elasticity of 2,100 tons/cm$^2$.

EXAMPLE 2

After a heavy residual oil having a boiling point of more than 350° C. prepared by distillation of Middle East crude oil (B) was subjected to hydrogenation treatment under a condition comprising a temperature of 390° C., a pressure of 160 Kgf/cm$^2$, a liquid space velocity of 0.5 Hr$^{-1}$ and a ratio of hydrogen/oil of 1,000 Nm$^3$/Kl, a fraction having a boiling point of 500° C. or less was removed by reduced pressure distillation. The resulting reduced pressure residual oil was subjected to solvent extraction treatment with heptane as a solvent under a condition comprising a ratio of solvent to oil of 10:1, a temperature of 180° C. and a pressure of 40 Kgf/cm$^2$. The resulting extraction component was subjected to thermal modification at a temperature of 400° C. for 15 hours to obtain a pitch used as a raw material for carbon fibers.

Properties of the heavy residual oil from Middle East crude oil (B) used as a raw material, those of the solvent extraction component and those of the pitch used as a raw material for carbon fibers are shown in Table 1.

Further, carbon fibers which were obtained by melt spinning of the above-described pitch used as a raw material for carbon fibers at 370° C., infusiblizing at 260° C. in the air and carbonizing at 1,000° C. had a tensile strength of 10 tons/cm$^2$ and a modulus of elasticity of 1,000 tons/cm$^2$.

COMPARATIVE EXAMPLE 1

A heavy residual oil having a boiling point of 350° C. or more prepared by distillation of Middle East crude oil (A) was subjected to reduced pressure distillation to remove a fraction having a boiling point of 500° C. or less.

The resulting reduced pressure distillation residual oil was subjected to thermal modification at a temperature of 410° C. for 10 hours.

Properties of the heavy residual oil from Middle East crude oil (A) used as a raw material and those of the pitch in this case are shown in Table 1.

When fibers were produced by melt spinning of the above-described pitch at 350° C., infusiblizing at 260° C. in the air and graphitizing at 1,000° C., they had a tensile strength of 5.5 tons/cm$^2$ and a modulus of elasticity of 350 tons/cm$^2$.

TABLE 1

| | Example 1 | Example 2 | Comparative Example 1 |
|---|---|---|---|
| Properties of raw material | | | |
| Specific gravity @ 15/4° C. | 0.955 | 0.960 | 0.955 |
| Kinetic viscosity cSt @ 50° C. | 230 | 550 | 230 |
| Residual carbon content wt % | 8.5 | 11 | 8.5 |
| S wt % | 3.0 | 4.3 | 3.0 |
| N ppm | 1,950 | 2,200 | 1,950 |
| V ppm | 29 | 60 | 29 |
| Ni ppm | 8 | 15 | 8 |
| Asphaltene content wt % | 2.0 | 3.2 | 2.0 |
| Properties of component after solvent extraction treatment by process of the present invention | | | |
| Specific gravity @ 15/4° C. | 0.940 | 0.951 | |
| Kinetic viscosity cSt @ 100° C. | 26.1 | 30.5 | |
| Residual carbon content wt % | 6.1 | 7.6 | |
| S wt % | 1.2 | 2.2 | |
| N ppm | 300 | 310 | |
| V ppm | 5 | 10 | |
| Ni ppm | 3 | 5 | |
| Asphaltene content wt % | 0.03 | 0.04 | |
| Properties of pitch | | | |
| Specific gravity @ 25/25° C. | 1.30 | 1.32 | 1.32 |
| Softening point °C. | 330 | 320 | 335 |
| Quinoline insoluble content wt % | 19.8 | 18.5 | 23.1 |

While the invention has been described in detail and with reference to specific embodiments thereof, it will be apparent to one skilled in the art that various changes and modifications can be made therein without departing from the spirit and scope thereof.

What is claimed is:

1. A process for producing a pitch for using as a raw material for producing carbon fibers, comprising the steps of:

subjecting a petroleum heavy residual oil comprising a fraction having a boiling point of 300° C. or more to hydrogenation treatment in the presence of a catalyst under a condition comprising a temperature of 370° to 450° C., a pressure of 70 to 210 Kgf/cm$^2$, a liquid space velocity of 0.4 to 2.0 Hr$^{-1}$ and a ratio of hydrogen/oil of 700 to 1,700 Nm$^3$/Kl, removing a fraction having a boiling point of 500° C. or less by reduced pressure distillation, subjecting the resulting reduced pressure distillation residual oil to solvent extraction treatment using a saturated hydrocarbon compound having 3 to 7 carbon atoms as a solvent under a condition comprising a ratio of solvent to oil of 3:1 to 15:1, a temperature of 50° to 230° C. and a pressure of 5 to 50 Kgf/cm$^2$, and carrying out thermal modification of the extracted material by heating at 390° to 430° C.

2. A process for producing a pitch as a raw material for producing carbon fibers, which comprises the steps of:

hydrogenating a petroleum heavy residual oil comprising a fraction having a boiling point of 300° C. in the presence of a hydrogenation catalyst at 370° to 450° C., a pressure of 70 to 210 Kgf/cm$^2$, a liquid space velocity of 0.4 to 2.0 Hr$^{-1}$ and a hydrogen/oil ratio of 700 to 1,700 Nm$^3$/Kl;

removing a fraction having a boiling point of about 450° C. or less reduced pressure distillation;

subjecting the resulting reduced pressure distillation residual oil to solvent extraction using one or more saturated hydrocarbon compound solvents having 3 to 7 carbon atoms at a solvent to oil ratio of 3:1 to 15:1, a temperature of 50° to 230° and a pressure of 5 to 50 Kgf/cm$^2$ to obtain an extract having a sulfur content of 2.5 wt% or less, a vanadium content of 15 ppm or less, a nickel content of 7 ppm or less, and an asphaltene content of 0.05 wt% or less; and thermally modifying the resulting extraction component at a temperature of 390° to 430° C.

* * * * *